US011627408B1

(12) United States Patent
Goh et al.

(10) Patent No.: US 11,627,408 B1
(45) Date of Patent: Apr. 11, 2023

(54) PASSIVE RADIATOR ASSEMBLY

(71) Applicant: Top Victory Investments Limited, Hong Kong (HK)

(72) Inventors: Gozali Goh, Singapore (SG); Hean Chow Liew, Singapore (SG)

(73) Assignee: Top Victory Investments Limited, Hong Kong (HK)

( * ) Notice: Subject to any disclaimer, the term of this patent is extended or adjusted under 35 U.S.C. 154(b) by 0 days.

(21) Appl. No.: 17/519,470

(22) Filed: Nov. 4, 2021

(51) Int. Cl.
*H04R 1/28* (2006.01)
*H04R 1/02* (2006.01)

(52) U.S. Cl.
CPC ..... *H04R 1/2834* (2013.01); *H04R 1/02* (2013.01); *H04R 1/2896* (2013.01)

(58) Field of Classification Search
CPC ..... H04R 1/2815; H04R 1/2819; H04R 1/283
See application file for complete search history.

(56) References Cited

U.S. PATENT DOCUMENTS 4,301,332 A * 11/1981 Dusanek ..... H04R 1/2834 381/349
6,704,426 B2 * 3/2004 Croft, III ..... H04R 1/2842 381/345
6,782,112 B1 * 8/2004 Geddes ..... H04R 1/2834 381/345
11,575,985 B2 * 2/2023 Azmi ..... H04R 1/2823

FOREIGN PATENT DOCUMENTS

CN 107404693 A 11/2017

* cited by examiner

*Primary Examiner* — Suhan Ni
(74) *Attorney, Agent, or Firm* — Hamre, Schumann, Mueller & Larson, P.C.

(57) ABSTRACT

A passive radiator assembly includes a surrounding unit and an inner radiator cone. The surrounding unit includes a top layer surrounding an axis, and a bottom layer being spaced apart from and disposed under the top layer, and surrounding the axis. The inner radiator cone interconnects the top layer and the bottom layer of the surrounding unit.

9 Claims, 6 Drawing Sheets

PASSIVE RADIATOR ASSEMBLY

FIELD

The disclosure relates to a speaker system, and more particularly to a passive radiator assembly for a speaker system.

BACKGROUND

Referring to FIGS. 1 and 2, Chinese Patent No. 107404693 discloses two conventional passive radiators 100, 200. The first conventional passive radiator 100 (see FIG. 1) has a vibrating portion 101, and two suspension rings 102 connected to and surrounding the vibrating portion 101. Such double suspension structure (i.e., the suspension rings 102) allows for high excursion but is susceptible to nonlinear motion (e.g., wobbling). The second conventional passive radiator 200 has top and bottom diaphragms 201, 202, each of which has a suspension ring 203. Having a dual layer structure (i.e., two diaphragms), the second conventional passive radiator 200 is sturdier than the first conventional passive radiator 100. However, since the top and bottom diaphragms 201, 202 are not connected to each other, their movements are independent and still susceptible to nonlinear motion.

SUMMARY

Therefore, the object of the disclosure is to provide a passive radiator assembly that can alleviate the drawback of the prior art.

According to the disclosure, the passive radiator assembly includes a surrounding unit and an inner radiator cone. The surrounding unit includes a top layer surrounding an axis, and a bottom layer being spaced apart from and disposed under the top layer, and surrounding the axis. The inner radiator cone interconnects the top layer and the bottom layer of the surrounding unit.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
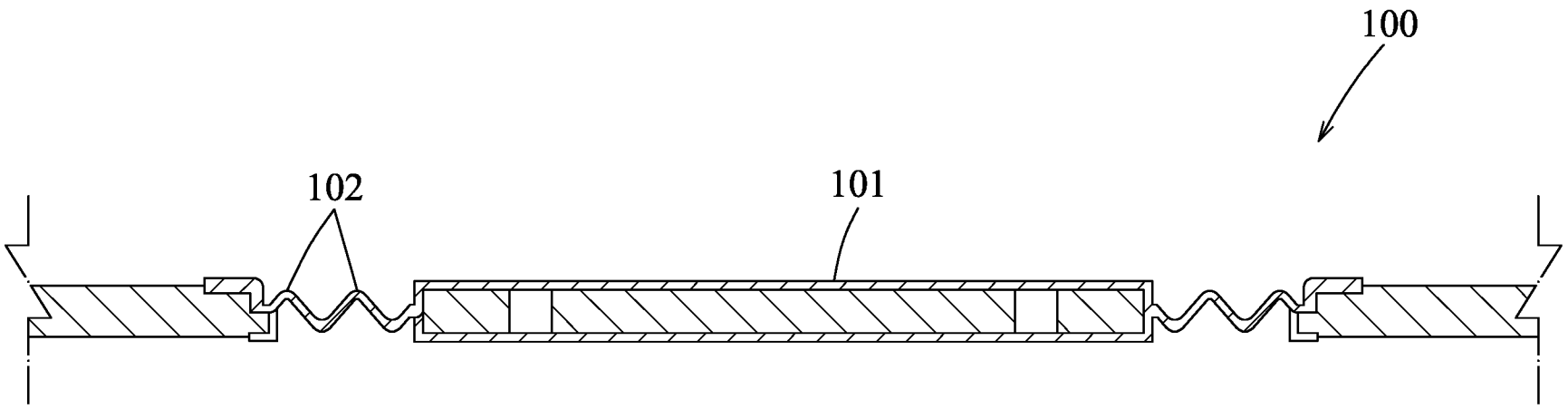
FIG. 1 PRIOR ART
FIG. 1 is a sectional view of a conventional passive radiator disclosed in Chinese Patent No. 107404693 A.
Figure 2:
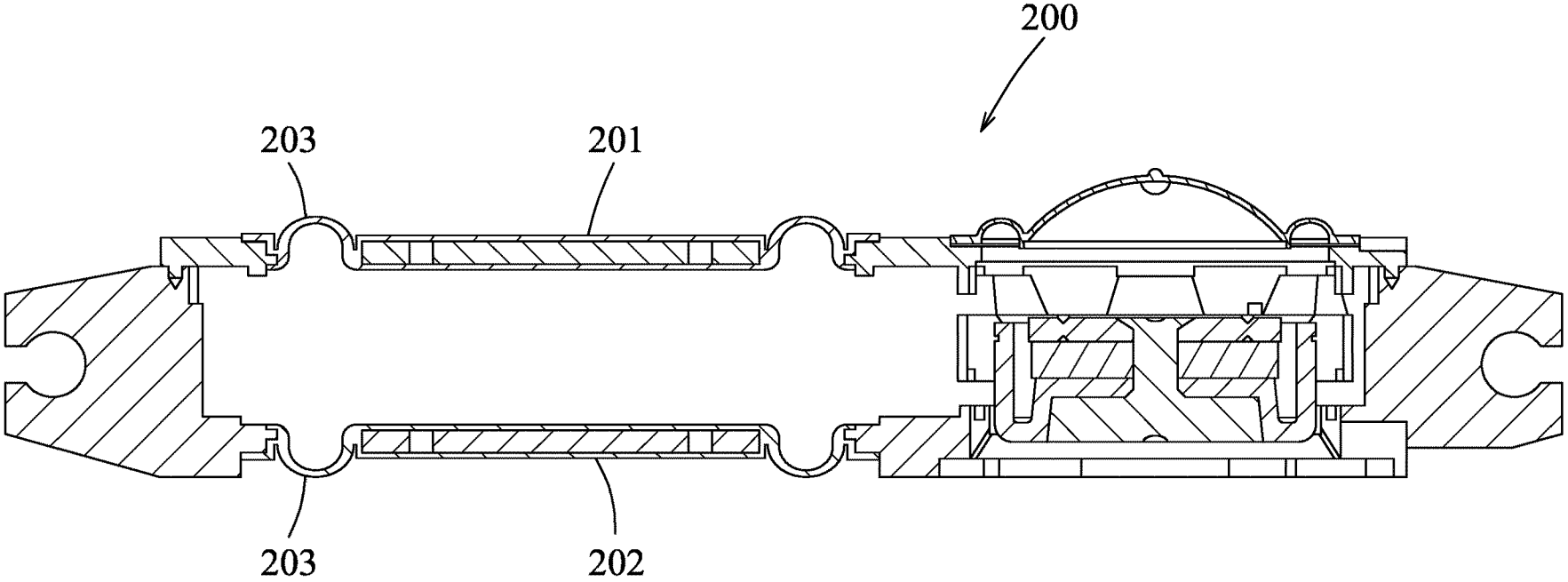
FIG. 2 PRIOR ART
FIG. 2 is a sectional view of another conventional passive radiator disclosed in Chinese Patent No. 107404693 A.
Figure 3:
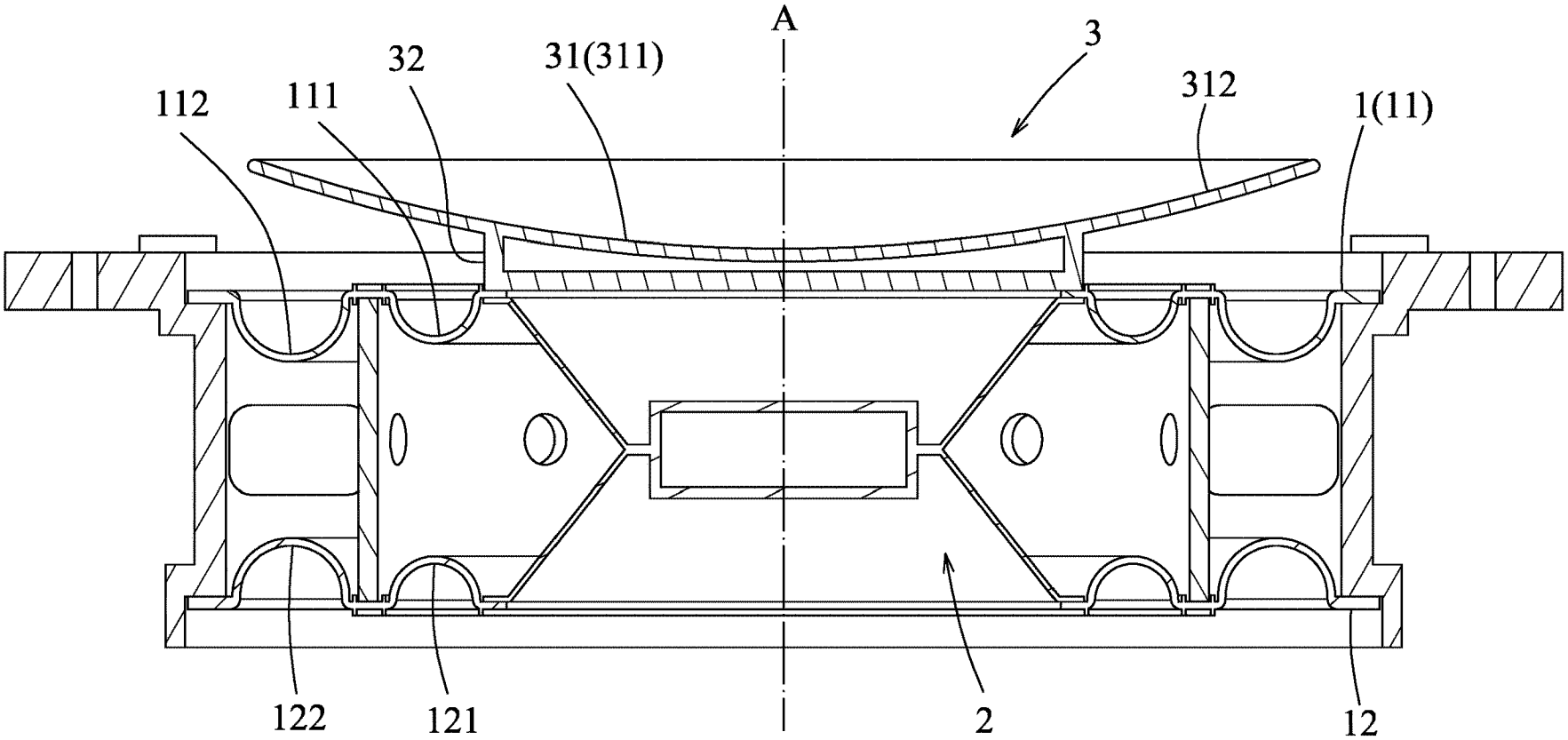
FIG. 3 is a sectional view of an embodiment of a passive radiator assembly according to the disclosure.

Referring to FIG. 3, an embodiment of a passive radiator assembly according to the disclosure is adapted for use in a speaker system (not shown), and includes a surrounding unit 1, an inner radiator cone 2 and an outer radiator cone 3.

The surrounding unit 1 includes a top layer 11 that surrounds an axis (A), and a bottom layer 12 that is spaced apart from and disposed under the top layer 11, and that surrounds the axis (A).

The top layer 11 of the surrounding unit 1 has an annular inner surrounding member 111 that is concave towards the bottom layer 12, and an outer surrounding member 112 that is spaced apart from and surrounds the inner surrounding member 111, and that is concave towards the bottom layer 12. The bottom layer 12 of the surrounding unit 1 has an inner surrounding member 121 that is concave towards the top layer 11, and an outer surrounding member 122 that is spaced apart from and surrounds the inner surrounding member 121, and that is concave towards the top layer 11.

The inner radiator cone 2 interconnects the top layer 11 and the bottom layer 12 of the surrounding unit 1. Specifically, the inner radiator cone 2 is connected to an inner periphery of the top layer 11 and an inner periphery of the bottom layer 12 of the surrounding unit 1.

The outer radiator cone 3 is connected to the top layer 11 of the surrounding unit 1, and is disposed above the inner radiator cone 2 along the axis (A). The outer radiator cone 3 has a bowl-shaped portion 31 and a connecting portion 32.

The bowl-shaped portion 31 of the outer radiator cone 3 has a middle segment 311 that is spaced apart from the inner radiator cone 2, and an outer segment 312 that extends outwardly and upwardly from a periphery of the middle segment 311, and that is disposed directly above the top layer 11 of the surrounding unit 1. The outer segment 312 of the concave portion 31 covers a major portion of the top layer 11 of the surrounding unit 1, which maximizes the effective radiating surface area.

The connecting portion 32 of the outer radiator cone 3 is shaped as a hollow vertical cylinder, and has an open upper end connected to the bowl-shaped portion 31, and a closed lower end connected to the top layer 11 of the surrounding unit 1.

It should be noted that, in term of providing the same benefit of allowing for high excursion, the inner surrounding member 111, 121 and the outer surrounding member 112, 122 of each of the top and bottom layers 11, 12 are not limited to being concave toward each other in the present embodiment.

Figure 4:
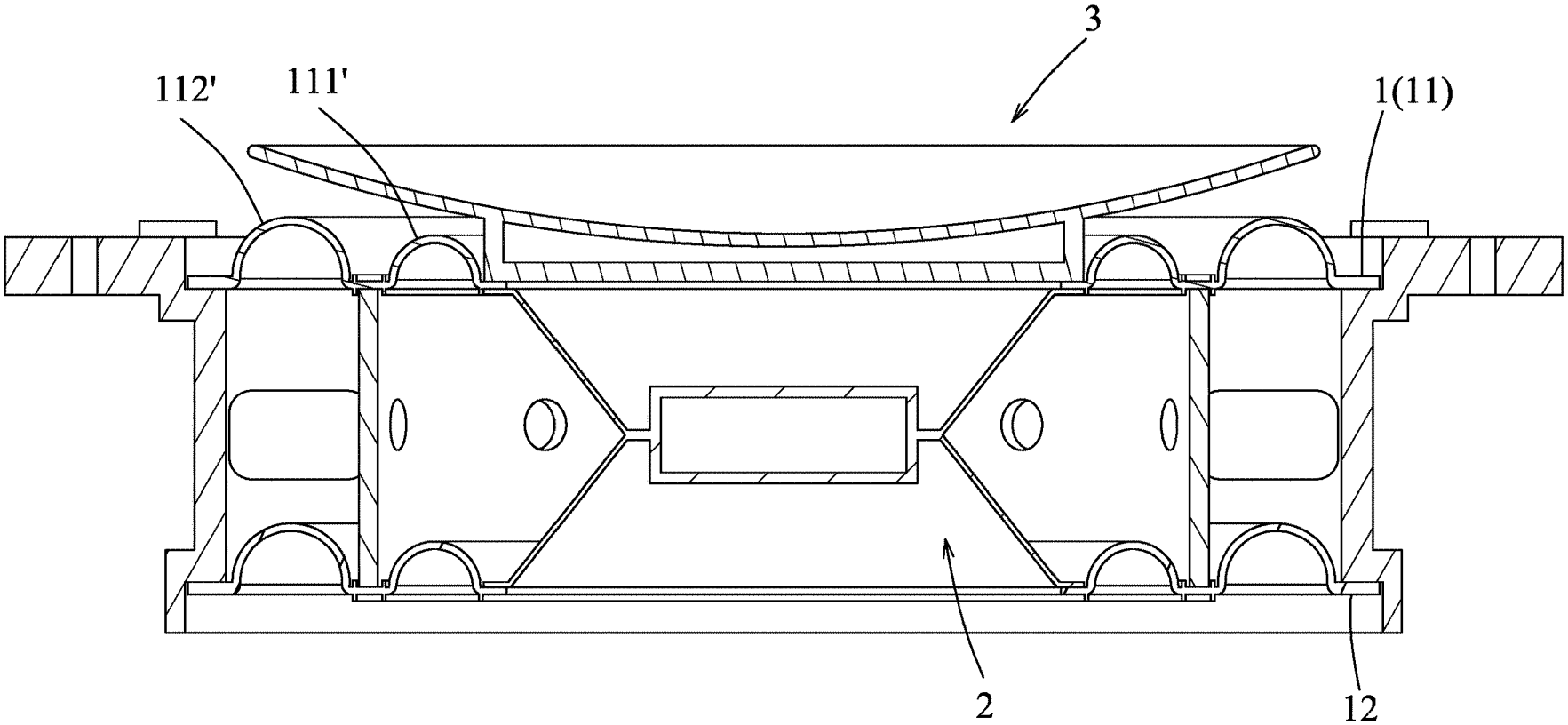
FIG. 4 is a sectional view of a first variation of the embodiment.
Figure 5:
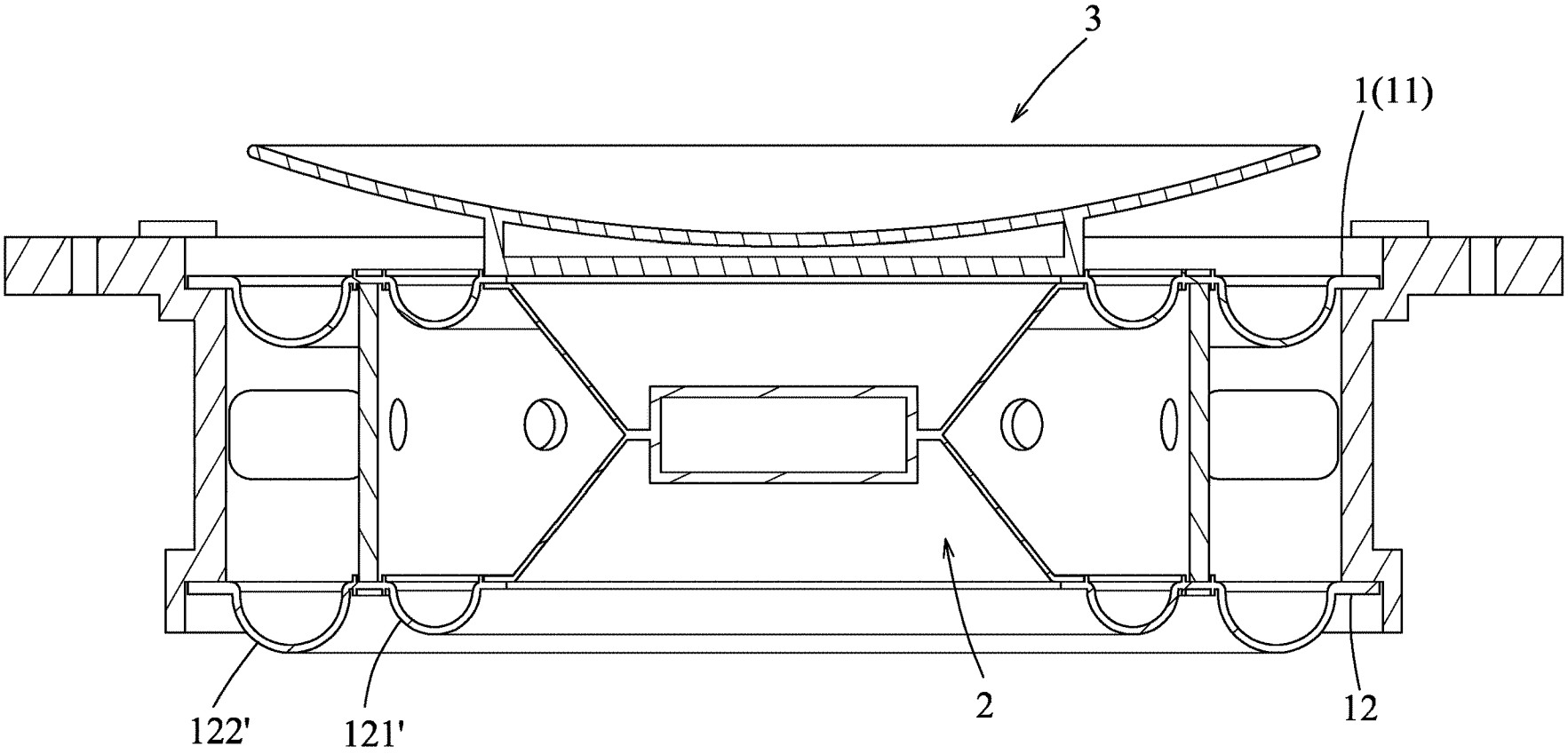
FIG. 5 is a sectional view of a second variation of the embodiment.
Figure 6:
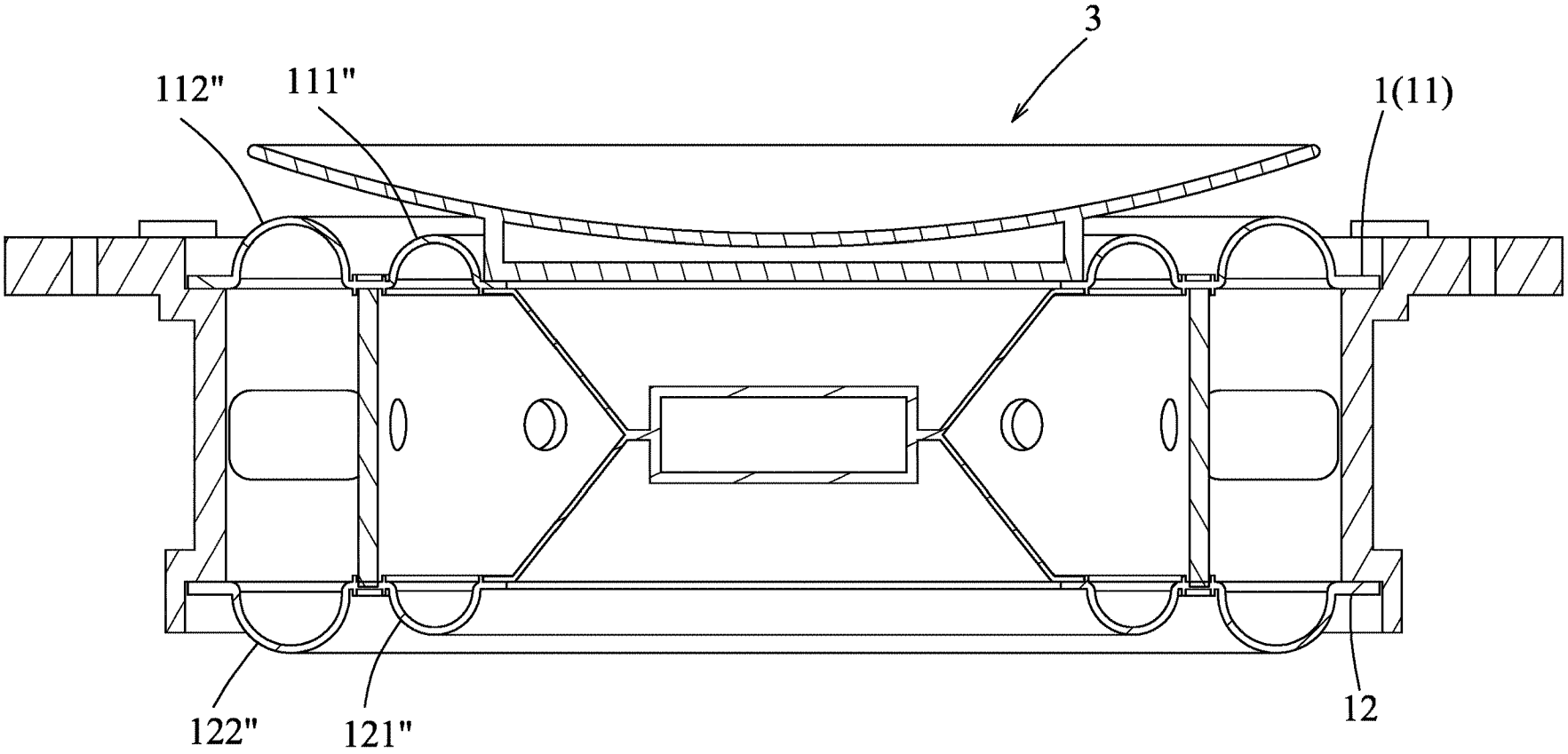
FIG. 6 is a sectional view of a third variation of the embodiment.

For example, referring to FIGS. 4 to 6, in a first variation of the embodiment (see FIG. 4), the inner and outer surrounding members 111', 112' of the top layer 11 are convex (curving upwardly) instead of being concave. Similarly, in a second variation of the embodiment (see FIG. 5), the inner and outer surrounding members 121', 122' of the bottom layer 12 are convex, and finally in a third variation of the embodiment (see FIG. 6), the inner and outer surrounding members 111", 112", 121", 122" of both of top the bottom layers 11, 12 are convex.

In sum, the passive radiator assembly of the present disclosure has benefits as follows.

By virtue of the inner and outer surrounding members 111, 121, 112, 122 of the top and bottom layers 11, 12 and the inner radiator cone 2 interconnecting the top and bottom layers 11, 12, the present embodiment of the passive radiator assembly allows for high excursion with minimal nonlinear motion (e.g., wobbling). In addition, the bowl-shaped portion 31 of the outer radiator cone 3 not only has great structural strength and rigidity, but maximizes the effective radiating surface area of the embodiment, thereby enabling higher sound pressure.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A passive radiator assembly comprising:
a surrounding unit that includes
a top layer surrounding an axis, and
a bottom layer being spaced apart from and disposed under said top layer, and surrounding the axis;
an inner radiator cone that interconnects said top layer and said bottom layer of said surrounding unit; and
an outer radiator cone that is connected to said top layer of said surrounding unit, said inner radiator cone and said outer radiator cone being arranged along the axis,
wherein said outer radiator cone has
a bowl-shaped portion that has
a middle segment being spaced apart from said inner radiator cone, and
an outer segment extending outwardly and upwardly from a periphery of said middle segment and disposed directly above said top layer of said surrounding unit, and
a connecting portion that is shaped as a hollow vertical cylinder and that has an oven upper end connected to said bowl-shaved portion and a closed lower end connected to said top layer of said surrounding unit.

2. The passive radiator design as claimed in claim 1, wherein said outer segment of said bowl-shaped portion of said outer radiator cone covers a major portion of said top layer of said surrounding unit.

3. The passive radiator design as claimed in claim 1, wherein said inner radiator cone is connected to an inner periphery of said top layer and an inner periphery of said bottom layer of said surrounding unit.

4. The passive radiator design as claimed in claim 1, wherein said top layer of said surrounding unit has:
an annular inner surrounding member that is concave towards said bottom layer; and
an annular outer surrounding member that is spaced apart from and surrounds said inner surrounding member, and that is concave towards said bottom layer.

5. The passive radiator design as claimed in claim 1, wherein said bottom layer of said surrounding unit has:
an annular inner surrounding member that is concave towards said top layer; and
an annular outer surrounding member that is spaced apart from and surrounds said inner surrounding member, and that is concave towards said top layer.

6. The passive radiator design as claimed in claim 1, wherein said top layer of said surrounding unit has:
an annular inner surrounding member that is upwardly convex; and
an annular outer surrounding member that is spaced apart from and surrounds said inner surrounding member, and that is upwardly convex.

7. The passive radiator design as claimed in claim 1, wherein said bottom layer of said surrounding unit has:
an annular inner surrounding member that is downwardly convex; and
an annular outer surrounding member that is spaced apart from and surrounds said inner surrounding member, and that is downwardly convex.

8. A passive radiator assembly comprising:
a surrounding unit that includes
a top layer surrounding an axis, and
a bottom layer being spaced apart from and disposed under said top layer, and surrounding the axis; and
an inner radiator cone that interconnects said top layer and said bottom layer of said surrounding unit;
wherein said top layer of said surrounding unit has
an annular inner surrounding member that is concave towards said bottom layer, and
an annular outer surrounding member that is spaced apart from and surrounds said inner surrounding member, and that is concave towards said bottom layer.

9. A passive radiator assembly comprising:
a surrounding unit that includes
a top layer surrounding an axis, and
a bottom layer being spaced apart from and disposed under said top layer, and surrounding the axis; and
an inner radiator cone that interconnects said top layer and said bottom layer of said surrounding unit;
wherein said bottom layer of said surrounding unit has
an annular inner surrounding member that is concave towards said top layer, and
an annular outer surrounding member that is spaced apart from and surrounds said inner surrounding member, and that is concave towards said top layer.

* * * * *